US006553750B2

(12) United States Patent
Stephan et al.

(10) Patent No.: US 6,553,750 B2
(45) Date of Patent: Apr. 29, 2003

(54) PROCESS AND DEVICE FOR THE PRODUCTION OF A YARN IN AN OPEN-END SPINNING DEVICE

(75) Inventors: Adalbert Stephan, Beilngries/Paulushofen (DE); Romeo Pohn, Geisenfeld/Rottenegg (DE); Lovas Kurt, Böhmfeld (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/819,002

(22) Filed: Mar. 27, 2001

(65) Prior Publication Data

US 2002/0014067 A1 Feb. 7, 2002

(30) Foreign Application Priority Data

Mar. 28, 2000 (DE) ..... 100 15 396
Jun. 23, 2000 (DE) ..... 100 30 892

(51) Int. Cl.[7] ..... D01H 4/10
(52) U.S. Cl. ..... 57/404; 57/93
(58) Field of Search ..... 57/1 R, 92, 93, 57/94, 100, 104, 105, 261, 263, 264, 400, 404, 405, 406, 407

(56) References Cited

U.S. PATENT DOCUMENTS 4,276,741 A * 7/1981 Stahlecker et al. ..... 57/263
5,456,073 A * 10/1995 Thierron et al. ..... 57/263
5,557,916 A * 9/1996 Messmer et al. ..... 57/261
5,584,170 A * 12/1996 Stahlecker ..... 57/263
5,694,756 A * 12/1997 Lindner ..... 57/263
5,865,022 A 2/1999 Bode et al.
6,035,622 A * 3/2000 Fox et al. ..... 57/263

FOREIGN PATENT DOCUMENTS

DE 2360296 A1 12/1973
DE 2341528 A1 * 3/1975
DE 2910814 A1 3/1979

OTHER PUBLICATIONS

German Search Report dated Jun. 26, 2000.
German Search Report dated Jan. 11, 2001.
Article—Die Suessen–WST CleanCat—Die Suessen WST SpinCat—für Rotorspinnmaschinen der Fa. Suessen, S. 1–7.

* cited by examiner

*Primary Examiner*—Danny Worrell
*Assistant Examiner*—Shaun R Hurley
(74) *Attorney, Agent, or Firm*—Dority & Manning, P.A.

(57) ABSTRACT

A spinning rotor of an open-end spinning device is slowed down for piecing to a low rotational piecing speed and is then accelerated to the operating speed. For this purpose, the spinning rotor or an element in driving connection with it is presented a drive transmission device from a service unit by means of which the spinning rotor can be switched from normal production speed to a reduced piecing speed and back. In this process, the drive transmission device can be driven either by a driving apparatus installed on the service unit or by a drive belt extending within spinning machine. The driving apparatus mounted on the service unit is connected to a control device for the control of the evolution of the rotational speed of the spinning rotor. The spinning rotor is driven according to a rotational speed course controlled by means of a program applied by the control device during the time when its rotational speed deviates from its operating speed.

33 Claims, 2 Drawing Sheets

PROCESS AND DEVICE FOR THE PRODUCTION OF A YARN IN AN OPEN-END SPINNING DEVICE

BACKGROUND OF THE INVENTION

The present invention relates to a process for the piecing of a yarn in an open-end spinning device as well as to a device to carry out this process.

With the high operating speeds of the spinning rotors that are in general use today piecing under operational conditions cannot be carried out or can be carried out only with difficulty. When they are carried out, the piecing joint produced does not meet the necessary requirements. For this reason, piecing takes place as a rule at a low rotational piecing speed of the spinning rotor, whereby the feeding and the drawing off of the pieced yarn from the spinning rotor is adapted to the rotational speed of the spinning rotor which runs up again to operational speeds at the latest after the piecing process (DE 2360296 A1).

Furthermore, it is a known method to maintain the rotational speed of the spinning rotor within a predetermined range of rotational speeds during the piecing process. For this purpose, a brake is assigned to the spinning rotor to be brought to bear upon the spinning rotor or to release it as a function of the measured rotational speed behavior of the spinning rotor (DE 44 03 120 A1). However, only an approximate influence can be exerted upon the rotor speed, since a change in brake application can be undertaken only as a consequence of an ascertained deviation from the rotational speed. Thus, fluctuation of the spinning rotor's actual rotational speed around the predetermined target speed cannot be avoided.

OBJECTS AND SUMMARY OF THE INVENTION

It is a principal object of the present invention to create a possibility to control the rotor speed in a desired manner not only during the piecing process but also during the time when the rotor speed deviates from its operational speed. Additional objects and advantages of the invention will be set forth in part in the following description or may be obvious from the description, or may be learned through practice of the invention.

The above-mentioned object is attained through a process using a drive transmission device located on a service unit. By providing a drive transmission device, it is possible to drive the spinning rotor in a precise manner at a desired rotational speed, or following a desired evolution of rotational speeds, during the piecing process when the spinning rotor does not rotate at its operating speed. The drive transmission device can then remain in use until the operating speed of the spinning rotor has been reached. It is, however, also possible to deactivate it earlier, when a controlled evolution of the spinning rotor speed has been achieved through other measures.

For the drive transmission device, a driving apparatus is preferably installed on the service unit so that such a driving apparatus need not be provided separately for every open-end spinning device. The solution according to the invention is thus economical from the point of view of material requirements as well as space requirement. Thanks to the direct control of the rotational rotor speed, a very precise evolution of the rotational rotor speed is achieved.

The rotational speed of the spinning rotor is advantageously increased in a controlled manner during the piecing process. This type of control of the rotational rotor speed makes it possible to maintain this rotational speed for the piecing process at a rotational speed level or within a rotational speed range such as to lead to optimal results with respect to the piecing joint produced.

It is advantageous for the running up of the spinning rotor to its operating speed to take place in coordination with the fiber feeding of the spinning rotor and/or the drawing off of the spun yarn from the spinning rotor. For this, it can be a distinct advantage if it were not the spinning rotor but, for example, the rotational speed of the bobbin winding up the drawn-off yarn that is taken as a guiding value to which the running-up of the spinning rotor and the fiber feed are controlled, because of the different inertia of such bobbins.

It is furthermore useful if the characteristics of the fiber material to be spun and/or the characteristics of the yarn being produced are taken into account for the control of the spinning rotor speed.

Alternatively, a process can be applied according to which no driving apparatus for the spinning rotor is provided on the service unit. Rather, the spinning rotor is driven at the required speed in every work phase by means of a change in the transmission ratio between a driving apparatus located in the spinning station and the spinning rotor, the change being controlled in the service unit.

In an advantageous embodiment of the process according to the invention, the rotor speed is maintained at least substantially constant during piecing.

In another advantageous further development of the process, the drive transmission device can be presented to an element directly or indirectly connected to the spinning rotor in order to drive the rotor, instead of being presented to the spinning rotor itself A drive transmission device connected to a control device is used to carry out the process according to the invention. By assigning a controlled drive transmission device to the spinning rotor, the latter can be driven precisely at the low speed desired for the piecing process.

In an advantageous embodiment of the device according to the invention, the drive transmission device can be associated with a controlled driving apparatus which can be designed as part of the piecing apparatus.

The piecing apparatus is provided with an actuating element in order to actuate the drive transmission device.

According to the invention, provisions can be made for the drive transmission device to be connected indirectly to the spinning rotor via one or several interposed elements during the piecing process, instead of being connected directly to the spinning rotor.

In a preferred embodiment of the invention, a friction wheel is provided, which drives the spinning rotor via an interposed supporting disk that supports the spinning rotor.

The control device is advantageously programmable. Here, a control connection between the drives of the spinning rotor, of the feed device and of a draw-off device of the pieced yarn can be provided in an advantageous further development.

It is an advantage if a device supplying a reference value for the control of the rotational speed is provided. Furthermore, a device to influence the evolution of the spinning rotor speed as a function of the characteristics of the fiber material to be spun or of the yarn to be produced can be provided.

The process and the device according to the invention make possible a precise and simple control of the rotor speed during piecing. Reliability during spinning can be increased in this manner, and the resulting piecing joint can be improved.

Examples of embodiments of the invention are explained below through drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
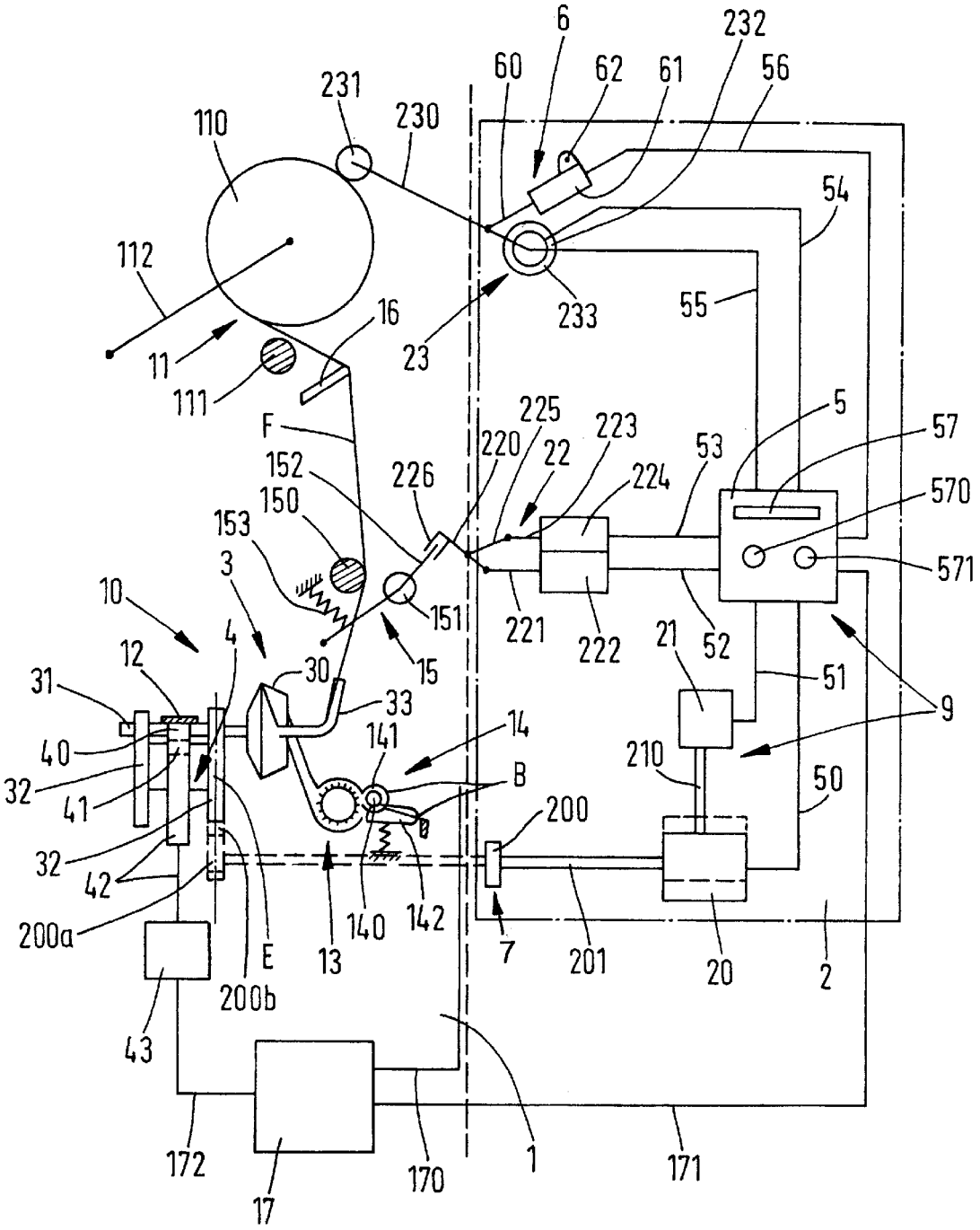
FIG. 1 shows a device according to the invention of a rotor spinning machine including its control connections in a schematic lateral view.

In FIG. 1, on the left side of the drawing, a broken line indicates a rotor-spinning machine 1, while a service unit 2 is indicated on the right side of the drawing by means of a dash-dot line.

Normally, a rotor spinning machine 1 has a plurality of identical workstations 10 located side by side, alongside which the earlier-mentioned service unit 2 can move to enable service of each one of these workstations 10 when necessary. Such service includes exchanging a full bobbin 110 with an empty bobbin (not shown) or piecing a yarn F following an interruption of production at a workstation 10 and then resuming the spinning process.

At each of these workstations 10 installed side by side, an open-end spinning device 3 is provided. It is provided with a spinning rotor 30 as a spinning element, which is provided with a rotor shaft 31 according to the embodiment shown by means of which it is supported and driven. The spinning rotor 30 is supported in a known manner by its rotor shaft in the nip of supporting disks 32. In addition, normally an axial support is also provided for the spinning rotor 30. This support is not shown and described because it is not needed in order to understand the present invention. This also applies to other normally used elements that are not shown in the figures and are not described therefore, but it is understood of course that such elements and aggregates are provided in the usual way.

A drive belt 12 extending along the plurality of workstations 10 drives the spinning rotor 30 at a high rotational speed, the operating speed, during normal production.

To be able to stop the spinning rotor 30 when necessary, a device 4 is provided which has on the one hand a lifting device 40 to lift the drive belt 12 from the rotor shaft 31, and on the other hand a braking device 41 which can be brought to bear on the rotor shaft 31 to stop the spinning rotor 30. In the embodiment shown, the lifting device 40 and the braking device 41 are linked together by means of a rod system 42 in such manner that when the drive belt 12 is lifted from the rotor shaft 31, the braking device 41 is applied to the latter. Conversely, when the braking device 41 releases the rotor shaft 31, the drive belt 12 is again applied on the rotor shaft 31. Further, the rotor shaft 31 can be released by the braking device 41 in an intermediate position without application of the drive belt 12 on the rotor shaft.

The rod system 42 is connected to a drive or actuating device 43 that is connected via a control circuit 172 to a control device 17. The above-mentioned drive stages of the spinning rotor 30 (driven by drive belt 12, released by drive belt 12 and braking device 41, or stopped by the applied braking device 41) can be controlled by this actuating device 43.

The fibers to be spun (not shown) are presented to the spinning rotor 30 by means of an opener device 13 that detaches these fibers in a known manner from the leading end of a fiber sliver B that is fed to it by means of a feeding device 14. The latter is normally provided with a feed roller 140 driven by means of a drive 141. A feed trough 142 interacts with the feed roller 140 and is subjected in a known manner to the force of a pressure spring or similar device to hold the fiber sliver B elastically between the device and the feed roller 140.

The drive 141 of the feeding device 14 is connected by means of a control circuit 170 to the previously mentioned control device 17. The latter may be designed, e.g., as a central control device for a plurality of workstations 10 or may be assigned merely to one single workstation 10 and be connected to a central control device (not shown) with which other workstations and control devices (not shown) are connected for control.

The yarn F spun from the fibers in the spinning rotor 30 is drawn off from the spinning rotor 30 through a yarn draw-off pipe 33 by means of a draw-off device 15. The latter is provided with a driven draw-off roller 150 to which a plurality of workstations 10 located next to each other are assigned, as well as with an individual pressure roller 151 mounted on a swiveling lever 152. This swiveling lever 152 is subjected to the force of an elastic element (in the embodiment shown, an extension spring 153) in such manner that the pressure roller 151 is pressed elastically against the driven draw-off roller 150 during normal spinning operation.

In the draw-off direction, the draw-off device 15 is followed by a yarn tension compensation hoop 16 ensuring that the yarn F fed to the bobbin 110 is essentially under a constant tension, independently of its traversing position.

The bobbin 110 is located in a winding device 11 and is driven by-a winding roller 111 in normal spinning operation. The bobbin 110 is held rotatably between two swiveling bobbin holders 112.

As mentioned previously, a service unit 2 interacts with the workstations 10 of the rotor-spinning machine 1. It is provided with a piecing apparatus 9 that is provided in the shown embodiment with a driving apparatus 20 of a drive transmission device 7, a lifting device 21 and a lifting device 22 as well as with an auxiliary drive 23 as essential elements.

The drive transmission device 7 is provided with a drive transmission wheel 200 located at the end of a driven shaft 201 that is capable of displacement in the axial direction. The drive transmission wheel 200 is located in the end position indicated by a continuous line within the contours of the service unit 2, so that the latter is able to travel unhindered alongside the rotor spinning machine 1. In its other position 200*a* indicated by a broken line, the drive transmission wheel 200 is in a common plane E with the supporting disk 32. The driving apparatus 20 is designed so that, in addition to the described displacement, it is able to cause also the rotation of the shaft 201 supporting the drive transmission wheel 200.

A lifting device 21 with a lifting rod 210 is assigned to the driving apparatus 20 and serves to move the driving apparatus 20 in such manner that the drive transmission wheel 200 can be brought from the position 200*a* indicated by the broken line to press against the supporting wheel 32 located in the same plane E as the drive transmission wheel 200 (drive transmission position 200*b*).

The driving apparatus 20 as well as the lifting device 21 is connected to a control device 5 located on the service unit 2 by means of a control circuit 50 or 51.

A lifting device 22 mounted on the service unit 2 can be presented to the swiveling lever 152 with the pressure roller 151 of the draw-off device 15. This lifting device 22 has a swiveling lever 220 which is mounted according the embodiment shown so as to be capable of swiveling on.a piston rod 221 which can in turn be moved in axial direction by a drive 222 (cylinder or similar device). An additional piston rod 223 is connected to a drive 224 and bears a coupling element 225 that is articulatedly connected at its other end to the swiveling lever 220 between its two ends. To be able to control the swiveling lever 220 in the desired manner, the two drives 222 and 224 are connected to the control device 5 by means of control circuits 52 or 53.

The bobbin 110 can be lifted by means not shown here from the driven winding roller 111 so that it then assumes the position shown in FIG. 1. In this lifted position of the bobbin 110 it can be assigned an auxiliary drive 23 which is provided with a swiveling arm 230 with an auxiliary drive roller 231 at its free end. The arm 230 is associated with a swivel drive 232 that is connected via a control circuit 54 to the control device 5. The auxiliary roller 231 is associated with a drive 233 that is connected via a control circuit 55 to the control device 5 of the service unit 2.

The winding device 11 is assigned a monitoring device 6. According to the embodiment shown as an example in FIG. 1, this monitoring device 6 has a rod 60 connected to the arm 230 between its ends. This rod is mounted pivotably on an axis 62 by means of a scanning device 61 provided with a housing. This scanning device 61 has the task of detecting the position of the rod 60 relative to itself The scanning device 61 is connected by means of a control circuit 56 to the control device 5.

The control device 5 shown here has a receiving bay 57 into which a data carrier, e.g., a CD-ROM, a diskette, etc., can be introduced on which a basic program for the piecing of the yarn F is stored.

The control device 5 is connected by means of a control circuit 171 to the control device 17 of the rotor-spinning machine 1.

The normal production of a yarn F takes place in the usual manner. A fiber sliver B is fed by means of the feeding device 14 to the opener device 13 which continuously detaches fibers from the leading end of the fiber sliver B and conveys them to the rotating spinning rotor 30 in which the fibers are deposited in form of a fiber ring. The end of the continuously drawn off yarn F is in contact with this fiber ring and, as it is drawn off, constantly integrates the fiber ring. The drawing off of the yarn is caused by the draw-off device 15, in that the pressure roller 151 is held in elastic contact against the driven draw off roller 150 and thus conveys the yarn F held in the draw-off device. The yarn F is guided over the yarn tension compensation hoop 16 and is traversed by means of a traversing device not shown here as it is wound up on the bobbin 110. During that time, the bobbin is pressed against the driven winding roller 111.

If an interruption of production occurs, be it as a result of an accidental yarn breakage or as a result of a stoppage of the open-end spinning device 3 of an individual workstation 10 or of the entire rotor spinning machine 1 brought about purposely by an operator, this termination or interruption of production takes place in the usual manner. Among other things, at least the drive 141 of the feeding device 14 and the bobbin 110 are stopped. The bobbin 110 is stopped in the usual manner, by lifting it from the winding roller 111, and therefore is not shown.

When production is to be resumed again, the service unit 2 travels to the workstation 10 to be started up again in order to carry out the piecing process. At that point in time at the latest, the spinning rotor 30 is stopped by means of the device 4 and its rod system 42. The drive belt 12 is at the same time lifted from the rotor shaft 31 and the braking device 41 is caused to act on the rotor shaft 31.

Piecing is controlled by the control device 5 of the piecing apparatus 9 to which the devices and aggregates used during piecing are connected for control.

In preparation of piecing, the auxiliary drive 23 is first presented to the bobbin 110 which has been lifted off from the winding roller 111. The drive 233 drives the auxiliary drive roller 231 so that the bobbin 110 is rotated in unwinding direction, while a not-shown yarn take-up device searches for the yarn end located at the surface of the bobbin, grasps the end and takes it up in accordance with the reverse rotation speed of the bobbin 110. The yarn end is put into an optimal state for piecing in the usual manner (by means which are also not shown here) and is then placed in readiness position in proximity of the spinning rotor 30, whereby the return feeding of the yarn F can be interrupted once or several times as a function of the required yarn movements and treatments by stopping the drive 233. During the return feeding of the yarn F into the mentioned readiness position in proximity of the spinning rotor 30, a yarn reserve (not shown) is normally formed which is needed for the subsequent actual piecing. When the yarn F has reached the readiness position, the auxiliary drive roller 231 is stopped.

In synchronization with the return feeding of the yarn end into a readiness position from which the actual piecing takes place at the given point in time, the pressure roller 151 of the draw-off device 15 is lifted from the draw-off roller 150 which continues to be driven as before. For this purpose, the piston rod 221 is pushed in the direction of the rotor-spinning machine 1 by means of the drive 222. The drive 224 is not yet actuated. In this manner and during the advance of the piston rod 221, the swiveling lever 220, which is articulatedly mounted at the end of this piston rod 221, is swiveled up by the coupling link 225 and by the piston rod 223 which remains behind. Upon completion of this advance movement, the grasper 226 is located above the free end of the swiveling lever 152 supporting the pressure roller 151. By actuating the drive 224, the swiveling lever 220 is now lowered and seizes the swiveling lever 152 supporting the pressure roller 151. Simultaneous withdrawal of the piston rods 221 and 223 by means of their drives 222 and 224 causes the swiveling lever 152 to be pulled away from the draw-off roller 150 so that the pressure roller 151 also moves away from the latter.

For piecing, it is necessary that the spinning rotor 30 rotates at a very defined rotational speed with which the start of fiber feeding into the spinning rotor 30, the quantity of the fibers to be fed, the return delivery of the yarn end in the readiness position into the rotating spinning rotor, and the drawing off of the yarn F must be synchronized.

To be able to drive the spinning rotor 30 at the desired rotational speed, the control device 5 of the piecing apparatus 9 actuates the driving apparatus 20. The shaft 201 bearing the drive transmission wheel 200 is moved from the starting or rest position, indicated by a continuous line, out of the service unit 2 in the direction of the rotor spinning machine 1 to the point that the drive transmission wheel 200 reaches its position 200*a* in which it is in the same plane E with the supporting disk 32.

By actuating the lifting device 21, the driving apparatus 20 is now moved with the drive transmission wheel 200 at the end of shaft 201 in such manner that the drive transmission wheel 200 reaches its drive transmission position 200*b* and is thereby pressed against the circumference of the supporting disk 32. At this latest point in time, the driving apparatus 20, which, in addition to the axial displacement of the shaft 201, also causes the driven rotation of this shaft 201. Thereby, the rotation of the drive transmission wheel 200 is actuated in such manner that the drive transmission wheel 200 is rotated in a controlled manner. This rotation in turn causes the rotor shaft 31 and thereby the spinning rotor 30 to rotate via the intercalated supporting disk 32. The rotation caused by the control device 5 by means of the driving apparatus 20 is controlled in such manner that the spinning rotor 30 is brought to its rotational speed selected for piecing.

The rotational speed of the spinning rotor 30 can be kept constant during the subsequent piecing process or can be driven in a controlled manner with minimal acceleration, so that the piecing process described below is carried out within a rotational speed range of the spinning rotor 30 that is predetermined by the control device 5.

The operational steps described above have prepared the actual piecing that can now be carried out. First, the drive 141 of the feeding device 14 resumes operation so that fibers reach the interior of the rotating spinning rotor 30 and are deposited therein in form of a forming fiber ring. The yarn end is then fed back into the spinning rotor 30 by releasing the previously formed yarn reserve until it is in contact with the accumulated fibers therein.

In synchronization with the resumption of fiber feed into the spinning rotor 30 and the return feeding of the yarn into the spinning rotor 30, the drawing-off of the yarn F from the spinning rotor 30 is resumed. For this purpose, the drive 233 of the auxiliary drive roller 231 is actuated by the control device 5 of the piecing apparatus 9 in such manner that the bobbin 110 is driven in the winding direction. The winding speed is increased for this in accordance with a predetermined program in the form of an acceleration curve until it reaches the full operating speed of the bobbin 110. Since the pressure roller 151 is lifted off from the draw-off roller 150, the bobbin 110 becomes the draw-off device for the spun yarn F during the piecing draw-off.

During this run-up of the bobbin 110, the rotational speeds of the spinning rotor 30 and of the feed roller 140 are increased so that the rotational speed of the spinning rotor 30 and of the feed roller 140 and of the bobbin 110 are coordinated with each other until the operating speed is reached. They remain thus coordinated, but this does not necessarily mean that the speed ratios among these rotational speeds must remain unchanged during the entire time. Since the centrifugal force in the spinning rotor 30 increases during its run-up, the force increasingly hinders the propagation of the rotation from the yarn draw-off pipe 33 in which the rotation of the yarn F originates to the point at which the yarn end incorporates the fibers deposited in the fiber ring in the spinning rotor 30. Therefore, it may be advantageous to change this speed ratio as a function of the rotor speed in order to obtain a uniform yarn quality.

The acceleration of the bobbin 110, however, cannot be controlled as desired since its acceleration depends on its mass. The larger the bobbin 110 is, the greater the mass is to be driven and to be accelerated by the auxiliary drive roller 231. For this reason, the bobbin 110 cannot be accelerated, e.g., as a function of the acceleration of the feed roller 140, since the feed roller 140 has a very small mass and can therefore reach its operating speed very rapidly. For this reason, a scanning device 61 is provided in the shown embodiment to determine the diameter of the bobbin 110 driven by the auxiliary roller 231. The smaller the mass of the bobbin 110, the smaller its diameter is, so that the diameter of the bobbin 110 can be used as a reference value for the mass of the bobbin 110. The smaller the diameter of the bobbin 110, the lower the arm 230 with the auxiliary drive 231 descends in the direction of the winding roller 111. Therefore, the swiveling path of the arm 230 has a fixed ratio to the bobbin diameter and thus also to the mass of the bobbin 110.

The swiveling path of the arm 230 is ascertained by means of the scanning device 61 across from which the rod 60 articulatedly connected to the arm 230 can be displaced in an axial direction as a direct function of the bobbin diameter. The scanning device 61 reports the extent of displacement, or the position of the rod 60 relative to the scanning device 61, to the control device 5 which converts this information into control signals to control the rotational speed of the driving apparatus 20 to drive the spinning rotor 30, the rotational speed of the drive 233 of the auxiliary drive 23 of the bobbin 110, and the rotational speed of the drive 141 of the feeding device 14. If the scanning device 61 reports a large bobbin diameter to the control device 5, the control device 5 causes the acceleration of the spinning rotor 30 by means of the driving apparatus 20 to be slower than in the case of a smaller bobbin diameter. The drive 141 of the feeding device 14 and the drive 233 of the auxiliary drive 23 of the bobbin 110 are then driven correspondingly.

It goes without saying that the accelerations of the spinning rotor 30, the bobbin 110, and the feeding device 14 have a predetermined speed ratio relative to each other which can also change during the acceleration in accordance with a predetermined program. These speeds are only accelerated sufficiently so that the bobbin 110 is reliably able to follow the acceleration dictated by the drive 233.

The reference value for the rotor speed, however, need not necessarily be supplied by the bobbin 110. It may also be advantageous to control the acceleration of the bobbin 110 and the spinning rotor 30 as a function of a controlled acceleration of the feed roller 140. Since the leading end of the fiber sliver B reaches the full thickness of the fiber sliver B very rapidly, even when this end has been prepared especially for the piecing process, the feed roller 140 must be driven and accelerated very slowly to achieve acceptable results for the piecing joint (i.e., the point between the end of the return-fed yarn F and the beginning of the newly spun yarn F).

The evolution of the rotational speed of the spinning rotor 30 is controlled according to a predetermined program for the entire time during which its speed deviates from its operating speed.

In the period of time until the start of the piecing process, the evolution of the speed of the spinning rotor 30 does not play a significant role. Therefore, in accelerating it, one must only ensure that the period between the moment when the spinning rotor is first driven by the driving apparatus 20 and the actual piecing process, e.g., when a contact is established between the yarn F fed back into the spinning rotor 30 and the fibers deposited therein, is sufficiently long to bring the spinning rotor 30 up to its piecing speed during that period. Thus, it is possible, for instance, to bring the spinning rotor 30 in this case with high, uncontrolled acceleration to its piecing speed.

The acceleration of the spinning rotor 30 following piecing follows the program stored in the control device 5. Here, the acceleration of the spinning rotor 30 (and its feed roller 140) can be effected as a function of the size and mass of the bobbin 110 monitored by the monitoring device 6. Alternatively, the acceleration of the bobbin 110, the feed roller 140 and the spinning rotor 30 can be kept so minimal that the bobbin 110 can reliably follow the rotational speed course set for it by the auxiliary drive roller 231.

It is not absolutely required to use any one of the rotational speeds and subsequent accelerations important during piecing as a reference value for the other rotational speeds. Alternatively, all rotational speed courses of spinning rotor 30, bobbin 110 and feeding device 14 can be set directly by the control device 5.

When the spinning rotor 30, the feed roller 140 and the bobbin 110 have reached their respective operating speeds, the normal operating conditions are re-established. The driving of the bobbin 110 and the spinning rotor 30 effected until then by the service unit 2 can therefore be normalized again and be given back to the rotor spinning machine 1 itself The driving of the feeding device 14, however, already controlled until then by the control device 17 of the workstation 10 need not be switched over.

When it has reached its operating speed, the bobbin 110 is lowered on the winding roller 111 so that the latter takes over the driving of the bobbin 110 from then on, and the auxiliary drive roller 231 is lifted off the bobbin 110. Furthermore, by appropriate control of the drives 222 and 224, the swiveling lever 152 is released by the grasper 226 so that the swiveling lever 152 now brings the pressure roller 151 to bear upon the draw-off roller 150 under the action of the extension spring 153 and the yarn F is drawn off by the draw-off device 15 from the spinning rotor 30.

By actuating the actuating device 43, the rotor shaft 31 is released by the braking device 41 and, at the same time, the drive belt 12 is brought to bear on the rotor shaft 31. Furthermore, the actuation of the lifting device 21 causes the drive transmission wheel 200 to be removed from the supporting disk 32, whereupon the drive apparatus 20 stops the drive transmission wheel 200 of the drive transmission device 7 and causes the withdrawal of the latter to within the contours of the service unit 2.

When the service unit 2 no longer intervenes with any of the elements of the workstation 10 or no longer interacts with one of them, the service unit 2 leaves this workstation 10 to resume its task at another workstation 10.

FIG. 1 merely shows an example of an embodiment. Under the present invention, a number of variants of the shown device as well as of the described process are possible, e.g., by exchanging individual characteristics against equivalents or by other combinations of these characteristics or their equivalents. Thus, the drive transmission wheel 200 in the shown embodiment is presented to the supporting disk 32 by a movement within the plane E. Such a movement of the drive transmission wheel 200 is, however, not a requirement to carry out the described process. Alternatively, it is also possible to present the drive transmission wheel 200 not to the supporting disk 32 but to the rotor shaft 31 through a movement that is radial relative to the rotor shaft 31. Depending on the design of the open-end spinning device 3 or the workstation 10, this movement can deviate in this case from the shown embodiment where this presentation movement takes place from below to above and take place in another presentation direction within the plane E.

In principle, the drive transmission wheel 200 can be put in driving connection with any element that has a fixed rotational speed ratio to the rotational speed of the spinning rotor 30 in order to drive the spinning rotor 30 during the time when its speed deviates from its operating speed. As shown so far, this element can be constituted by one of the supporting disks 32 supporting the rotor shaft 31 (or the spinning rotor 30 itself, in a manner not shown). When such supporting disks 32 are provided for the direct or indirect support of the spinning rotor 30, such a drive has the additional advantage that the drive transmission wheel 200 need be driven only at a relatively low speed by the driving apparatus 20 of the service unit 2 in view of the transmission ratio between supporting disk 32 and rotor shaft 31 or spinning rotor 30.

As indicated earlier, the drive transmission wheel 200 can be brought into contact with the circumference of the spinning rotor 30 to be driven, especially when the spinning rotor 30 is supported directly (not shown) without using a rotor shaft 31 and/or supporting disks 32. The drive of the spinning rotor 30 can also be driven during normal production in some other known manner also without tangential belt 12 and thereby in deviation from the drawing in FIG. 1.

In another alternative embodiment, the driving apparatus 20 can be located in a swiveling housing (not shown). By being swiveled out of range of the service unit 2 together with the drive transmission device 7 constituted by the drive transmission wheel 200, the driving apparatus 20 can be brought into contact with the rotor shaft 31 or with another element in driving connection with the rotor shaft 31, e.g., the supporting disk 32, so that the direction of movement falls as a tangent into this plane E only in proximity of the drive transmission position **200*b* of the drive transmission wheel 200**.

In accordance with another variant that is not shown, the drive transmission wheel 200 can be located at least in its drive position in a plane (not shown) that intersects the shown plane E at essentially a right angle. In this case, the drive transmission wheel 200 that assumes its drive transmission position **200*b* is pressed against a face of the supporting disk 32. Here too the drive transmission wheel 200 can be presented to the element to be driven, e.g., rotor shaft 31, supporting disk 32 etc., in different manners, e.g., in form of a linear or circular movement. Presentation paths of different design are also possible, e.g., in that an element supporting the shaft 201 of the drive transmission wheel 200** moves in a guide in which it slides (not shown).

If the drive transmission wheel 200 and the element with which the drive transmission wheel 200 can be connected for driving is given an appropriate form, the drive transmission wheel 200 may be brought into contact with the supporting disk 32, etc., neither in a common plane E shared with supporting disk 32, etc., nor in a plane intersecting this plane E at a right angle. Rather, it is entirely possible to connect the drive transmission wheel 200 into driving connection with the element to be driven (supporting disk 32, spinning rotor 30, rotor shaft 31) at any desired angle.

The drive transmission wheel 200 can also be designed in a great variety of ways. Thus, a friction wheel, a toothed wheel (e.g., in form of a pinion gear), etc., can be used and be given a different form, e.g., that of a conical gear wheel, etc.

In deviation from the shown embodiment, it is also not required that the spinning rotor 30 be separated from the drive belt 12 by means of a rod system 42 bearing a lifting device 40 and a braking device 41 of the type shown. It is perfectly possible to design the lifting device 40 and the braking device 41 independent of each other and, e.g., to drive them with their own drives (solenoid, hydraulic or pneumatic cylinder, etc.), whereby these two not shown drives are connected for control to the control device 17.

In a variant of the shown device, the actuating device 43 need not be connected via a control circuit 172 to the control device 17 and via the latter to the control device 5. Instead, in an embodiment not show, the rod system 42 can be connected to a cover of the open-end spinning device 3 which can be opened and closed by a device connected to the control device 5 of the piecing apparatus 9 installed on the service unit 2, whereby the different drive states of the spinning rotor (driven by drive belt 12, released by drive belt 12 and braking device 41, as well as stopped by the applied braking device 41) are controlled as a function of the swivel position of the cover.

In addition to the receiving bay 57 for a suitable data support, the shown control device 5 is provided with two additional input devices 570 and 571 by means of which it is possible to intervene in the basic program supplied by the data support. The input device 570, for example, is a device for the input of the fiber characteristics pertaining to material, fiber length, curling characteristics, etc. By means of this input device 570 and the program stored in the control device 5, it is thus possible to change the piecing conditions accordingly, so that optimal piecing conditions with respect to fiber incorporation can be achieved at all times. In an analogous manner, the desired yarn characteristics with respect to twist, yarn thickness, etc., can be adjusted by means of the second input device 571. The piecing process and in particular also the evolution of the rotational speed of the spinning rotor 30 are influenced here in this manner by means of the two input devices 570 and 571. The constant piecing speed of the spinning rotor 30, e.g., the speed range of the spinning rotor 30 provided for piecing, can be adjusted here as a function of the settings selected by the input devices 570 and/or 571.

It is, of course, also possible to enter the inputs also by means of a combined input device (not shown) into the control device 5.

The embodiment of the control device 5 shown and described here with respect to programming and influencing the stored program is merely one possible embodiment example selected to explain the process and the device. Other embodiments of the control device 5, especially concerning controlling the evolution of the rotational speed of the spinning rotor 30, are entirely possible. In some cases, the control of the evolution of the rotational speed of the spinning rotor 30 is so precise that it is possible to do without adjusting or programming to take into account the characteristics of the fiber material and the yarn F to be produced.

Nor is it necessary to provide for a course of the piecing process in the manner described above. Other piecing courses where piecing takes place at a rotational speed of the spinning rotor 30 that is lower than its operating speed can be used, whereby the spinning rotor 30 is driven during the piecing process in the described manner by the driving apparatus 20 of the service unit 2 by means of the drive transmission device 7.

In the time during which the spinning rotor 30 is under the control of the service unit 2 and its driving apparatus 20, it is advantageous to suppress the direct drive of the spinning rotor 30 by the drive belt 12. This suppression is effected in a known manner by lifting the drive belt 12 off from the rotor shaft 31, as was described earlier by, e.g., using the actuating device 43 and the rod system 42. For this purpose, the control device 5 transmits an appropriate signal via the control circuit 171 to the control device 17, which in turn controls the actuating device 43 via control circuit 172.

In the examples of embodiments described above, the driving apparatus 20 is located on the service unit 2 traveling alongside the workstations 10. At variance with this in FIG. 2, an embodiment of a drive transmission device 70 is described below that dispenses with a dedicated, i.e., additional driving apparatus 20 of the spinning rotor 30. The drive transmission device 70 rather causes the drive belt 12 or another driving device provided in the rotor spinning machine 1 itself to be brought to bear on the spinning rotor 30 with different transmission ratios, depending on the work phase.

The drive transmission device 70 has as its essential element a holder 8 (indicated only schematically in FIG. 2) that holds a belt application roller 80, normally used in rotor spinning devices, and at the same distance, on the other side of the drive belt 12, a stepped roller 81 with a first zone 810 having a large diameter D and a second zone 811 having a smaller diameter d. The zone 810 of the stepped roller 81 with the large diameter D presses against the drive belt 12, at least during the time when the stepped roller 81 is to transmit the rotation received from the drive belt 12, while its zone 811 with the small diameter d presses against one of the supporting disks 32.

Figure 2:
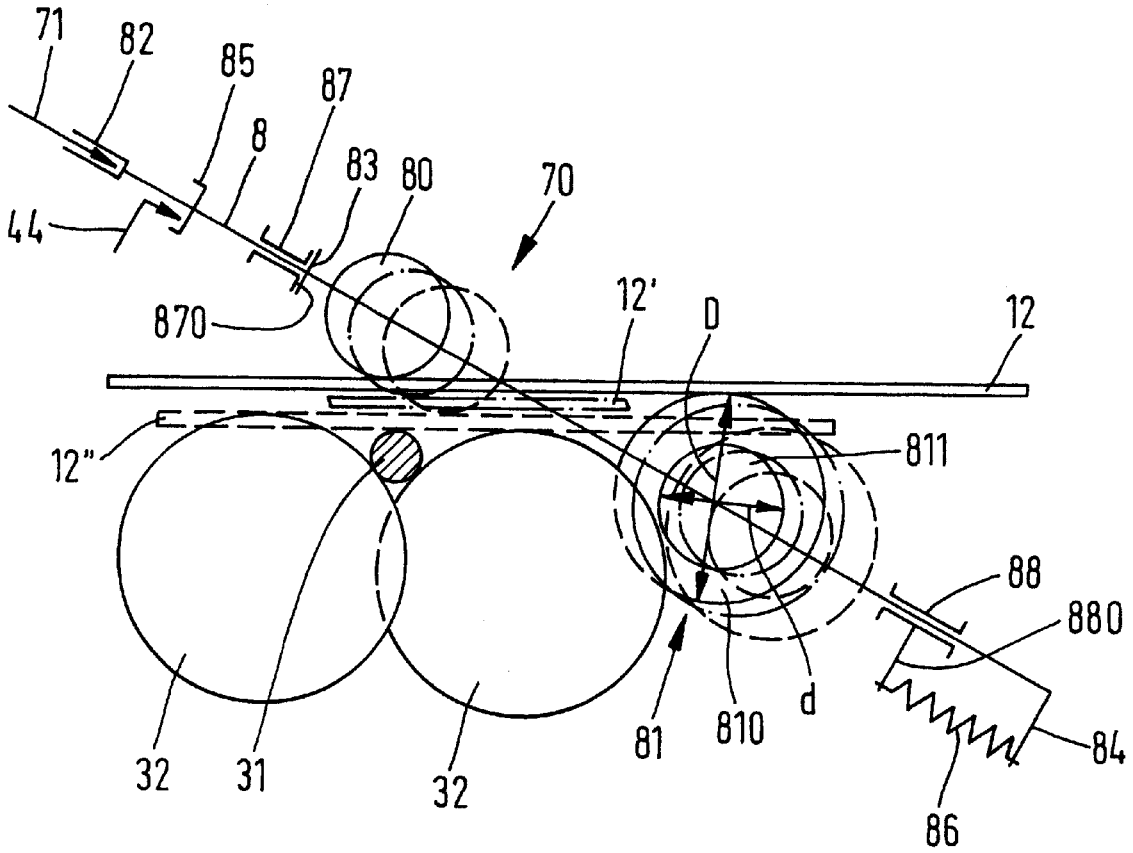
FIG. 2 is a schematic representation of the drive ratios pertaining to the spinning rotor during the piecing process, during stoppage, and during normal operation.

According to FIG. 2, the holder 8 is mounted by means of two stationary guides 87 and 88 provided in the workstation 10 so as to be capable of axial movement. It has an actuating stop 82 at a suitable location against which an actuating element 71 can be brought to bear. This actuating element 71, which is shown only schematically, is controlled by the control device 5 of the service unit 2 similarly to that which was described earlier in connection with the drive wheel 200. The differences are that the driving apparatus 20 does not impart any rotational drive and that the actuating element 71 is not presented to a supporting disk 32 but to the drive transmission device 70.

The actuating element 71 has the task of moving the drive transmission device 70 from a rest position in which it is non-operational into a transmission position in which it connects the drive belt 12 (or some other driving device provided in the rotor spinning machine 21) to the spinning rotor 30 to drive it.

The holder 8 is furthermore provided with a stop arm 83 which is in contact with a stationary stop 870 in its normal operating position. The stop 870 consists according to the embodiment shown in FIG. 2 of a face of the guide 87. The holder 8 is furthermore provided with an arm 84 in which the end of the extension spring 86 is anchored. The extension spring's other end is anchored in a stationary spring hook 880, which, e.g., can be supported by the guide 88.

The holder 8 has yet another actuating stop 85 to which a stopping lever 44 can be advanced. This stopping lever 44 is part of the device 4 described above through FIG. 1 and is suitably adapted to it. The stopping lever 44 is connected to the actuating device 43 (see FIG. 1) and is brought by the control device 17 to act upon the holder 8 when the open-end spinning device is stopped on purpose or accidentally (e.g., in case of yarn breakage).

The holder 8 constitutes the previously mentioned drive transmission device 70 whose three work positions are indicated in FIG. 2 by continuous, dash-dot or broken lines.

The change of position of the drive transmission device 70 for piecing is effected by means of the above-mentioned actuating element 71 that is controlled by the service unit 2 in a manner not shown, in order to take the holder 8 and thereby also the drive transmission device 70 into and out of operation.

During the normal, undisturbed spinning operation, the drive transmission device 70 is presented to the spinning rotor 30 (or to an element connected to it to drive it, in the embodiment shown with a supporting disk 32). Thereby, the actuating element 71 as well as the stopping lever 44 releases the holder 8, which thus, as a result of the action of the extension spring 86, together with the belt pressing roller 80 and the stepped roller 81 assumes the position indicated in FIG. 2 by a continuous line in which the stop arm 83 is pressed against the stationary stop 870. The stepped roller 81 is pressed in this case with its zone 810, having the larger diameter D, against the drive belt 12, while its zone 811 with the smaller diameter d is pressed against the supporting disk 32. Since the rotor shaft 31 is located in the nip between two supporting disks 32 or supporting disk pair, it (and through it the spinning rotor 30) is thus driven by the drive belt 12 located at the workstation 10 (i.e., extending through the workstation 10) via the stepped roller 81 and the supporting disk 32. Due to the transmission ratio resulting from the different diameters D and d of the zones 810 and 811 of the stepped roller 81 and between the zone 811 of the stepped roller 81 and the supporting disk 32, the spinning rotor 30 is driven at a speed that is substantially greater than if the rotor shaft 31 were driven directly by the drive belt 12.

Although not shown separately, it goes without saying that known means are provided to secure the rotor shaft 31 in the nip of the supporting disks 32. The rotor shaft 31 can be supported here in principle in the usual manner by means of one or two pairs of supporting disks 32. The supporting disks of a pair of supporting disks can be located in a known manner in a joint plane (see FIG. 1) or in a parallel plane (see FIG. 2) and if necessary with partial overlap.

In case of stoppage of the open-end spinning device 3, the holder 8 assumes an intermediate position (indicated by dashes and dots in FIG. 2) in which the stepped roller 81 is removed from the supporting disk 32 while the drive belt 12 has not come into contact with the rotor shaft 31 (see position 12'). For this action, the control device 17 and the actuating device 43 activate the cited stopping lever 44 as required.

If the open-end spinning device 3 is to be taken into operation again after a stoppage of the workstation 10 and of its aggregate, the actuating element 71 is first presented to the actuating stop 82 under the control emanating from the service unit 2 that has been called up in the meantime in a known manner. The holder 8 is moved against the action of the extension spring 86 in such a manner that the stepped roller 81 is removed even further from the drive belt 12 and also from the supporting disk 32 (see broken line drawn in FIG. 2). In this manner, the drive transmission device 70 continues to be kept out of action while the belt pressing roller 80 is pressed against the drive belt 12 (position 12") and presses it against the rotor shaft 31, so that the spinning rotor 30 is now driven directly by the drive belt 12. In this position of the holder 8, the stepped roller 81 is disengaged from the drive belt 12 as well as from the supporting disk 32. Since the transmission between drive belt 12 and rotor shaft 31 using transmission device 70 does not take place when the rotor is driven in this manner, the rotational piecing speed of the spinning rotor 30 is considerably slower than with the indirect drive via the stepped roller 81 and the supporting disk 32. In this piecing position of the drive transmission device 70 in which the spinning rotor 30 is driven in a defined manner at a constant rotational speed that is lower than its operating speed, the piecing process is now carried out in the known manner.

When the piecing process has been completed successfully, the actuating element 71 and, if this has not already occurred during the piecing process, the stopping lever 44 is pulled back now at the latest, so that the holder 8 is released. Due to the action upon it by the extension spring 86, the holder 8 follows this movement until its stop arm 83 comes into contact with the stop 870. Thereby, the drive belt 12 is disengaged from the rotor shaft 31, while the drive transmission device 70 transmits the movement of the drive belt 12 via the stepped roller 81 and the supporting disk 32 to the rotor shaft 31 and thereby also to the spinning rotor 30. The driven elements of the drive transmission device 70 (stepped roller 81) are thus driven in such a manner that the spinning rotor 30 runs up rapidly to its operating speed, and then remains at this operating speed. The normal drive conditions for production are re-established.

When all the elements intervening in the open-end spinning device 3 during the piecing phase have again been pulled back into the confines of the service unit 2, the latter can again leave the workstation 10 in order to carry out necessary service tasks at another workstation 10.

In the embodiment described above, the rotational speed of the spinning rotor 30 is set in a fixed manner by the relationship between production speed and piecing speed of the spinning rotor 30. The relationship can be changed if necessary by replacing the stepped roller 81 with one having a different diameter ratio of the zones 810 and 811 and thus adapted to the desired conditions.

A continuous adaptation is also possible, e.g., by designing the drive transfer from the stepped roller 81 to the supporting disk 32 or of an intermediate disk (not shown) interacting with the supporting disk 32 as a conical gear or similar device that can be adjusted as a function of current conditions to the desired speed ratio.

If the drive transmission device 70 by means of which the drive is taken away from a driving device 12 of the workstation 10 and is transferred to the spinning rotor 30 is active merely during the piecing and service phase, it can also be installed on the service unit 2 as an alternative and be presented to the open-end spinning device 3 only when needed. The transmission ratios must be selected in the latter case so that the spinning rotor 30 is driven in the desired manner at reduced speed when the drive transmission device 70 is active. In such a case, the spinning rotor is driven during normal production independently of the drive transmission device 70, contrary to the embodiment described above through FIG. 2.

Whether or not the drive transmission device 7 or 70 is active during the time when the spinning rotor 30 is rotating at its operating speed or during the time when the spinning rotor 30 rotates only at its piecing speed, the change from one of these speeds to the other is always caused by intervention of the service unit 2 in the driving of the spinning rotor 30. Thus, the drive transmission device can obtain its driving action from the service unit 2 (drive transmission device 7 in FIG. 1) or from a driving device (drive belt 12) of the rotor spinning machine 1 itself (drive transmission device 70 in FIG. 2).

It will be appreciated by those skilled in the art that various modifications and variations can be made in the present invention without departing from the scope of the invention. It is intended that the present invention include such modifications and variations as come within the scope of the appended claims and their equivalents.

What is claimed:

1. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device with a driving apparatus in such a manner that the drive transmission device drives the open-end spinning device;

manipulating the drive transmission device and the driving apparatus to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn; and accelerating the open-end spinning device from the reduced piecing speed to the operational production speed at a point in time after the piecing of the yarn occurs by properly manipulating the drive transmission device and the driving apparatus.

2. A process as in claim 1, wherein the drive transmission device engages and drives the open-end spinning device at a point in time when production of the yarn within the open-end spinning device has ceased, the drive transmission device engaging a component of the open-end spinning device in a manner that drives the open-end spinning device at a reduced piecing speed.

3. A process as in claim 2, further comprising increasing the rotational speed of the open-end spinning device from the reduced piecing speed towards the operational production speed in a controlled manner during piecing.

4. A process as in claim 3, wherein the increasing of rotational speed of the open-end spinning device is controlled in coordination with at least the fiber feed or the yarn take-up of the workstation of the spinning machine.

5. A process as in claim 1, wherein the drive transmission device engages the open-end spinning device before the production of the yarn begins and drives the open-end spinning device during the production of the yarn at the operational production speed in combination with the driving apparatus, the service unit disengaging the drive transmission device from the open-end spinning device and allowing the driving apparatus to drive the open-end spinning device upon servicing the open-end spinning device in a manner in which the open-end spinning device operates at a reduced piecing speed to allow proper piecing of the yarn.

6. A process as in claim 5, wherein the driving apparatus is a drive belt.

7. A process as in claim 1, wherein the reduced piecing speed of the open-end spinning device is kept constant during the piecing process.

8. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device; and wherein the drive transmission device is driven by a driving apparatus operably disposed to the service unit.

9. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device;

increasing the rotational speed of the open-end spinning device from the reduced piecing speed towards the operational production speed in a controlled manner during piecing;

wherein the drive transmission device engages and drives the open-end spinning device at a point in time when production of the yarn within the open-end spinning device has ceased, the drive transmission device engaging a component of the open-end spinning device in a manner that drives the open-end spinning device at a reduced piecing speed; and wherein the increasing of rotational speed of the open-end spinning device is a function of the diameter of a bobbin winding up yarn produced by the open-end spinning device.

10. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device;

increasing the rotational speed of the open-end spinning device from the reduced piecing speed towards the operational production speed in a controlled manner during piecing;

wherein the drive transmission device engages and drives the open-end spinning device at a point in time when production of the yarn within the open-end spinning device has ceased, the drive transmission device engaging a component of the open-end spinning device in a manner that drives the open-end spinning device at a reduced piecing speed; and wherein the increasing of rotational speed of the open-end spinning device is a function of material being spun.

11. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device;

increasing the rotational speed of the open-end spinning device from the reduced piecing speed towards the operational production speed in a controlled manner during piecing;

wherein the drive transmission device engages and drives the open-end spinning device at a point in time when production of the yarn within the open-end spinning device has ceased, the drive transmission device engaging a component of the open-end spinning device in a manner that drives the open-end spinning device at a reduced piecing speed; and wherein the increasing of rotational speed of the open-end spinning device is a function of desired characteristics of the yarn to be produced.

12. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device; and wherein the drive transmission device includes a drive transmission wheel.

13. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device; and wherein the drive transmission device engages a supporting disk of the open-end spinning device.

14. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device; and wherein the drive transmission device engages a rotor of the open-end spinning device.

15. A process for the production of a yarn in an open-end spinning device of a workstation within a spinning machine, the process comprising of the steps of:

operating the open-end spinning device of a workstation within a spinning machine at a specified operational production speed to produce the yarn;

engaging a component of the open-end spinning device with a drive transmission device;

driving the drive transmission device in such a manner that the drive transmission device drives the open-end spinning device;

manipulating the drive transmission device to operate the open-end spinning device at a reduced piecing speed as compared to the production speed at a point in time after the open-end spinning device has ceased producing the yarn to allow for proper piecing of the yarn;

coordinating a fiber feed and a yarn take-up with the reduced piecing speeds to insure the yarn produced during piecing is of the desired quality;

piecing the yarn during the operation of the open-end spinning device at the reduced piecing speed using a service unit to perform the piecing of the yarn;

accelerating the open-end spinning device from the reduced piecing speed to the operational production speed at a point in time after the piecing of the yarn occurs by properly manipulating the drive transmission device; and wherein the drive transmission device engages a rotor shaft of a rotor of the open-end spinning device.

16. A device for the production of a yarn in an open-end spinning device of a workstation within a spinning machine, said device comprising:

at least one drive transmission device operably disposed to said spinning machine, said drive transmission device engaging a component of said open-end spinning device;

a driving apparatus engaged with said drive transmission device, said driving apparatus operably driving said drive transmission device;

a traveling service unit disposed alongside said spinning machine, said service unit traversing said spinning machine and stopping and servicing said workstations as needed or called for;

a piecing apparatus configured with said service unit, said piecing apparatus piecing said yarn after a cease in production of said yarn in said open-end spinning device in a piecing process in which the desired qualities of said yarn are unaffected by said piecing process; and a control device in communication with said service unit and said piecing apparatus in a manner that allows said service unit to manipulate said drive transmission device engaged with said open-end spinning device so that said open-end spinning device operates at a reduced piecing speed during said piecing process and then returns said open-end spinning process to an operational production speed after said piecing apparatus properly pieces said yarn.

17. A device as in claim 16, wherein said control device is in communication with said drive transmission device to permit proper control of said drive transmission device by said service unit during said piecing process.

18. A device as in claim 17, wherein said drive transmission device engages said open-end spinning device at a point in time when production of said yarn within said open-end spinning device has ceased, said drive transmission device engaging said component of said open-end spinning device driving said open-end spinning device at said reduced piecing speed.

19. A device as in claim 18, wherein said drive transmission device is configured with said service unit.

20. A device as in claim 19, wherein said driving apparatus is in communication with said control device, said driving apparatus properly positioning said drive transmission device with respect to said component of said open-end spinning device and driving said drive transmission device which in turn drives said component of said open-end spinning device.

21. A device as in claim 18, wherein said control device controls said drive transmission device so that the rotational speed of the open-end spinning device increases from the reduced piecing speed towards the operational production speed in a controlled manner during piecing.

22. A device as in claim 18, wherein said control device is in communication with at least a feeding device which feeds fibers to be spun to said open-end spinning device or a draw-off device which draws-off said yarn spun by said open-end spinning device, said control device regulating the speed of said feed device and said draw-off device to control the acceleration of said open-end spinning device during the piecing process.

23. A device as in claim 16, wherein said drive transmission device engages said component of said open-end spinning device before the production of said yarn begins and drives said open-end spinning device during the production of said yarn at the operational production speed, said piecing apparatus disengaging said drive transmission device from said open-end spinning device and said driving apparatus upon servicing said open-end spinning device in a manner in which the open-end spinning device operates at said reduced piecing speed to allow proper piecing of said yarn.

24. A device as in claim 23, wherein the driving apparatus is a drive belt.

25. A device for the production of a yarn in an open-end spinning device of a workstation within a spinning machine, said device comprising:

at least one drive transmission device operably disposed to said spinning machine, said drive transmission device engaging a component of said open-end spinning device;

a driving apparatus engaged with said drive transmission device, said driving apparatus operably driving said drive transmission device;

a traveling service unit disposed alongside said spinning machine, said service unit traversing said spinning machine and stopping and servicing said workstations as needed or called for;

a piecing apparatus configured with said service unit, said piecing apparatus piecing said yarn after a cease in production of said yarn in said open-end spinning device in a piecing process in which the desired qualities of said yarn are unaffected by said piecing process; and a control device in communication with said service unit and said piecing apparatus in a manner that allows said service unit to manipulate said drive transmission device engaged with said open-end spinning device so that said open-end spinning device operates at a reduced piecing speed during said piecing process and then returns said open-end spinning process to an operational production speed after said piecing apparatus properly pieces said yarn;

wherein said control device is in communication with said drive transmission device to permit proper control of said drive transmission device by said service unit during said piecing process;

wherein said drive transmission device engages said open-end spinning device at a point in time when production of said yarn within said open-end spinning device has ceased, said drive transmission device engaging said component of said open-end spinning device driving said open-end spinning device at said reduced piecing speed;

wherein said drive transmission device is configured with said service unit;

wherein said driving apparatus is in communication with said control device, said driving apparatus properly positioning said drive transmission device with respect to said component of said open-end spinning device and driving said drive transmission device which in turn drives said component of said open-end spinning device; and wherein said component of said open-end spinning device that is engaged by said drive transmission device is a spinning element of said open-end spinning device.

26. A device for the production of a yarn in an open-end spinning device of a workstation within a spinning machine, said device comprising:

at least one drive transmission device operably disposed to said spinning machine, said drive transmission device engaging a component of said open-end spinning device;

a driving apparatus engaged with said drive transmission device, said driving apparatus operably driving said drive transmission device;

a traveling service unit disposed alongside said spinning machine, said service unit traversing said spinning machine and stopping and servicing said workstations as needed or called for;

a piecing apparatus configured with said service unit, said piecing apparatus piecing said yarn after a cease in production of said yarn in said open-end spinning device in a piecing process in which the desired qualities of said yarn are unaffected by said piecing process; and a control device in communication with said service unit and said piecing apparatus in a manner that allows said service unit to manipulate said drive transmission device engaged with said open-end spinning device so that said open-end spinning device operates at a reduced piecing speed during said piecing process and then returns said open-end spinning process to an operational production speed after said piecing apparatus properly pieces said yarn;

wherein said control device is in communication with said drive transmission device to permit proper control of said drive transmission device by said service unit during said piecing process;

wherein said drive transmission device engages said open-end spinning device at a point in time when production of said yarn within said open-end spinning device has ceased, said drive transmission device engaging said component of said open-end spinning device driving said open-end spinning device at said reduced piecing speed;

wherein said drive transmission device is configured with said service unit;

wherein said driving apparatus is in communication with said control device, said driving apparatus properly positioning said drive transmission device with respect to said component of said open-end spinning device and driving said drive transmission device which in turn drives said component of said open-end spinning device; and wherein said component of said open-end spinning device that is engaged by said drive transmission device is a supporting disk of said open-end spinning device.

27. A device as in claim 26, wherein said drive transmission device further comprising a transmission wheel operably integral to said driving apparatus so that said transmission wheel interfaces with said supporting disk causing said supporting disk to rotate said spinning element at said reduced piecing speed.

28. A device for the production of a yarn in an open-end spinning device of a workstation within a spinning machine, said device comprising:

at least one drive transmission device operably disposed to said spinning machine, said drive transmission device engaging a component of said open-end spinning device;

a driving apparatus engaged with said drive transmission device, said driving apparatus operably driving said drive transmission device;

a traveling service unit disposed alongside said spinning machine, said service unit traversing said spinning machine and stopping and servicing said workstations as needed or called for;

a piecing apparatus configured with said service unit, said piecing apparatus piecing said yarn after a cease in production of said yarn in said open-end spinning device in a piecing process in which the desired qualities of said yarn are unaffected by said piecing process;

a control device in communication with said service unit and said piecing apparatus in a manner that allows said service unit to manipulate said drive transmission device engaged with said open-end spinning device so that said open-end spinning device operates at a reduced piecing speed during said piecing process and then returns said open-end spinning process to an operational production speed after said piecing apparatus properly pieces said yarn;

wherein said drive transmission device engages said open-end spinning device at a point in time when production of said yarn within said open-end spinning device has ceased, said drive transmission device engaging said component of said open-end spinning device driving said open-end spinning device at said reduced piecing speed;

wherein said control device is in communication with said drive transmission device to permit proper control of said drive transmission device by said service unit during said piecing process;

wherein said control device is in communication with at least a feeding device which feeds fibers to be spun to said open-end spinning device or a draw-off device which draws-off said yarn spun by said open-end spinning device, said control device regulating the speed of said feed device and said draw-off device to control the acceleration of said open-end spinning device during the piecing process; and wherein said drive transmission device as directed by said control device quickly accelerates said open-end spinning device to the reduce piecing speed from a point in time when said open-end spinning device is at rest, while once the piecing is completed, said control device coordinates the acceleration of said drive transmission device, said feed device and said draw-off device, so that the accelerations are controlled to insure desired qualities in said yarn.

29. A device as in claim 28, wherein said feed device and said draw-off device provide a reference value speed and acceleration to said control device for determining said open-end spinning device reduced piecing speed and acceleration curve.

30. A device as in claim 29, further comprising a monitor operably linked to said control device to monitor at least said feed device or said draw-off device to provide information to determine said reference value speed and acceleration curve.

31. A device as in claim 30, wherein said monitor is operably configured with said service unit in a position to measure the diameter of a bobbin by which said yarn is drawn-off and unto which said yarn is wound, the measurements of said diameter for use in determining said reference value speed and acceleration curve.

32. A device for the production of a yarn in an open-end spinning device of a workstation within a spinning machine, said device comprising:

at least one drive transmission device operably disposed to said spinning machine, said drive transmission device engaging a component of said open-end spinning device;

a driving apparatus engaged with said drive transmission device, said driving apparatus operably driving said drive transmission device;

a traveling service unit disposed alongside said spinning machine, said service unit traversing said spinning machine and stopping and servicing said workstations as needed or called for;

a piecing apparatus configured with said service unit, said piecing apparatus piecing said yarn after a cease in production of said yarn in said open-end spinning device in a piecing process in which the desired qualities of said yarn are unaffected by said piecing process;

a control device in communication with said service unit and said piecing apparatus in a manner that allows said service unit to manipulate said drive transmission device engaged with said open-end spinning device so that said open-end spinning device operates at a reduced piecing speed during said piecing process and then returns said open-end spinning process to an operational production speed after said piecing apparatus properly pieces said yarn; and wherein said control device is programmable to factor in at least fiber characteristics or desired yarn characteristics when determining said reduced piecing speed and acceleration curve.

33. A device for the production of a yarn in an open-end spinning device of a workstation within a spinning machine, said device comprising:

at least one drive transmission device operably disposed to said spinning machine, said drive transmission device engaging a component of said open-end spinning device;

a driving apparatus engaged with said drive transmission device, said driving apparatus operably driving said drive transmission device;

a traveling service unit disposed alongside said spinning machine, said service unit traversing said spinning machine and stopping and servicing said workstations as needed or called for;

a piecing apparatus configured with said service unit, said piecing apparatus piecing said yarn after a cease in production of said yarn in said open-end spinning device in a piecing process in which the desired qualities of said yarn are unaffected by said piecing process;

a control device in communication with said service unit and said piecing apparatus in a manner that allows said service unit to manipulate said drive transmission device engaged with said open-end spinning device so that said open-end spinning device operates at a reduced piecing speed during said piecing process and then returns said open-end spinning process to an operational production speed after said piecing apparatus properly pieces said yarn;

wherein said drive transmission device engages said component of said open-end spinning device before the production of said yarn begins and drives said open-end spinning device during the production of said yarn at the operational production speed, said piecing apparatus disengaging said drive transmission device from said open-end spinning device and said driving apparatus upon servicing said open-end spinning device in a manner in which the open-end spinning device operates at said reduced piecing speed to allow proper piecing of said yarn; and wherein said piecing apparatus further comprising an actuating element that is interfaceable with said drive transmission device causing said drive transmission device to disengage said open-end spinning device and thereby allowing said driving device to operate said open-end spinning device at a reduced piecing speed.

* * * * *